US011512692B2

(12) United States Patent
Hachisuka

(10) Patent No.: US 11,512,692 B2
(45) Date of Patent: Nov. 29, 2022

(54) AIR COMPRESSOR

(71) Applicant: MAKITA CORPORATION, Anjo (JP)

(72) Inventor: Tomohiro Hachisuka, Anjo (JP)

(73) Assignee: MAKITA CORPORATION, Anjo (JP)

( * ) Notice: Subject to any disclaimer, the term of this patent is extended or adjusted under 35 U.S.C. 154(b) by 935 days.

(21) Appl. No.: 16/275,459

(22) Filed: Feb. 14, 2019

(65) Prior Publication Data

US 2019/0285065 A1 Sep. 19, 2019

(30) Foreign Application Priority Data

Mar. 15, 2018 (JP) ..... JP2018-047666

(51) Int. Cl.

| | |
|---|---|
| ***F04B 53/00*** | (2006.01) |
| ***F04B 53/20*** | (2006.01) |
| ***F04B 39/00*** | (2006.01) |
| ***F04B 41/02*** | (2006.01) |
| ***F04B 39/16*** | (2006.01) |

(52) U.S. Cl.

CPC ..... *F04B 53/004* (2013.01); *F04B 39/005* (2013.01); *F04B 39/0061* (2013.01); *F04B 39/16* (2013.01); *F04B 41/02* (2013.01); *F04B 53/20* (2013.01)

(58) Field of Classification Search

CPC .... F04B 39/005; F04B 39/0061; F04B 39/16; F04B 41/02; F04B 53/004; F04B 53/20; Y10S 55/17; B01D 45/0002

USPC ..... 137/171; 181/252; 417/312; 95/268

See application file for complete search history.

(56) References Cited

U.S. PATENT DOCUMENTS

| | | | | |
|---|---|---|---|---|
| 4,730,695 | A * | 3/1988 | Bar | F04B 39/0061 181/252 |
| 5,810,566 | A * | 9/1998 | Pauwels | F04B 39/005 417/312 |
| 2010/0290929 | A1* | 11/2010 | Ohi | F04B 41/02 417/360 |
| 2020/0109705 | A1* | 4/2020 | Suzuki | F04B 37/14 |

FOREIGN PATENT DOCUMENTS

| | | | |
|---|---|---|---|
| CN | 104074585 | A | 10/2014 |
| CN | 204921318 | U | 12/2015 |
| CN | 205306900 | U | 6/2016 |
| CN | 108361548 | A | 8/2018 |
| DE | 202016007222 | U1 | 12/2016 |
| JP | 2004-156555 | A | 6/2004 |
| JP | 2009-185678 | A | 8/2009 |
| JP | 2009185678 | A * | 8/2009 |

OTHER PUBLICATIONS

JP2009185678A_Description_English, "Air Compressor" (Year: 2009).*
Aug. 31, 2021 Office Action issued in Chinese Patent Application No. 201910042806.X.
Oct. 19, 2021 Office Action issued in Japanese Patent Application No. 2018-047666.

* cited by examiner

*Primary Examiner* — Dominick L Plakkoottam
*Assistant Examiner* — Charles W Nichols
(74) *Attorney, Agent, or Firm* — Oliff PLC

(57) ABSTRACT

A wool-like fiber member that has high permeability and low absorbability is disposed around a discharge port of a discharge pipe that is configured to discharge condensate and compressed air stored within a tank.

17 Claims, 7 Drawing Sheets

AIR COMPRESSOR

CROSS-REFERENCE

This application claims priority to Japanese patent application serial number 2018-047666, filed on Mar. 15, 2018, the contents of which are incorporated herein by reference in their entirety.

TECHNICAL FIELD

The present invention generally relates to the field of air compressors that generate and store compressed air.

BACKGROUND ART

Generally, an air compressor takes in outside air and brings it to the inside of a cylinder and compresses it using a piston to generate compressed air inside the cylinder. The compressed air thus generated is delivered to a storage tank to be stored.

The compressed air stored in the tank is supplied to an air-powered tool such as, for example, a nail driver for the operation. As the compressed air is supplied to the tool, in other words, to the outside of the storage tank, the remaining compressed air in the storage tank will expand. As a result, the compressed air will be cooled. Due to this cooling effect, water vapor primarily included in the remaining compressed air within the tank condenses to produce a condensate (water or drainage) which may accumulate inside the storage tank. The condensate accumulated in the tank can cause rust to develop within the tank and result in a decrease in the storage quantity of the compressed air. To avoid these defects, an air compressor having a condensate discharge portion for discharging the condensate to the outside of the storage tank has been generally used in the past. Such an air compressor is described in Japanese Patent Laid-Open Publication No. 2009-185678.

A condensate discharge portion may generally include a discharge pipe in fluid communication with the storage tank and a drain cock that serves to open and close the discharge pipe. When the drain cock is closed, the condensate and the compressed air in the storage tank are not discharged from the discharge pipe. When the drain cock is opened, the compressed air in the storage tank is discharged from a discharge port of the discharge pipe in accordance with the degree of opening of the drain cock. Furthermore, the condensate in the storage tank is discharged from the discharge port of the discharge pipe together with the compressed air.

The compressed air in the storage tank is stored at a high pressure such as, for example 4.5 mega Pascal (MPa). Due to this high pressure, the compressed air is rapidly discharged through expansion when the drain cock is fully opened. This may generate a loud noise. In order to reduce the noise, it is sometimes necessary to reduce the degree of opening of the drain cock to a small degree. However, when the degree of opening of the drain cock is reduced to a small degree, it takes a long time to fully discharge the condensate and the compressed air, and possibly inconvenience a user. In some cases, in order to reduce the noise, a muffling material, for example a porous material, is placed around the discharge port of the discharge pipe in the air compressor. However, when the muffling material is used, clogging may occur due to the condensate that is discharged together with the compressed air. This can result in deterioration of discharge performance.

As a result of the mentioned deficiencies in the art, there is a need in the art to reduce noise when the compressed air stored in the storage tank of the air compressor is discharged (when the pressure is released). Further, there is a need to discharge the condensate and the compressed air in an efficient manner.

SUMMARY

In one exemplary embodiment of the present disclosure, an air compressor comprises a compressing part that compresses outside air to produce compressed air, a storage tank that stores the compressed air, and a condensate discharge section from which condensate and the compressed air within the tank are configured to be discharged to the outside of the tank. Furthermore, the condensate discharge section includes a discharge pipe through which the condensate and the compressed air flow from the tank. It may also include a drain cock that serves to open and close the discharge pipe. Furthermore, the air compressor may further comprise a wool-like fiber member with high permeability. It may be disposed partially or fully around a portion of the discharge port of the discharge pipe.

According to the embodiment, the compressed air discharged from the discharge port of the discharge pipe may be dispersed to the minute gaps formed in the wool-like fiber member. Due to the dispersion of the compressed air, the energy that the compressed air possesses will be consumed. This reduces the noise and may also restrict the condensate from being scattered around the outside of the air compressor. Since the noise and the scattering of the condensate around the air compressor may be restricted, it may not be necessary to adjust the discharge amount of the compressed air and the condensate as in a conventional method. Instead, the compressed air and the condensate can be discharged in a vigorous manner to rapidly complete the discharging task. This can result in improved operability. Furthermore, according to this embodiment, the wool-like fiber member has high permeability (drainability) and very low water absorbency (water retentivity). Due to these features, the condensate and the compressed air discharged from the discharge port can flow without being retained in the minute gaps formed in the wool-like fiber member. Furthermore, permeability and water absorbency of the wool-like fiber member can be maintained and thus the condensate and the compressed air can be discharged in an efficient manner.

In another exemplary embodiment of the disclosure, the wool-like fiber member is made from metal.

According to such an embodiment, the wool-like fiber member made from metal is stronger and heavier than, for example, resin. Due to these features, the wool-like fiber member made from metal can be restricted from being damaged by the compressed air that is vigorously discharged. Furthermore, it can be restricted from being moved from its initial position. In addition to this, rust preventive measures can be taken by the use of the wool-like fiber member made of stainless steel. A metallic scrubbing brush, made of "steel wool" for example, can be used as the wool-like fiber member. Such a wool-like member does not require a specific size or shape. As a result, the air compressor according to this embodiment can be provided at a low cost.

In another exemplary embodiment of the disclosure, the wool-like fiber member may be disposed so as to cover a surrounding of the discharge port.

According to such an embodiment, the compressed air discharged from the discharge port of the discharge pipe can pass through the minute gaps formed in the wool-like fiber member in an easy manner. In this configuration, the noise generated by the compressed air can be furthermore reduced.

In another exemplary embodiment of the disclosure, the air compressor may further comprise a muffing chamber into which the discharge pipe is introduced. Furthermore, the muffling chamber may cover the surrounding of the discharge port. Finally, the wool-like fiber member may be disposed in an interior of the muffling chamber.

According to such an embodiment, the compressed air is discharged to the outside after it has been introduced to the interior of the muffling chamber. In this process, the noise generated by the compressed air can be further reduced. Furthermore, the muffling chamber can restrict the movement of the wool-like fiber member.

In another exemplary embodiment of the disclosure, the muffling chamber includes a wall that faces the discharge port.

In such an embodiment, compressed air introduced to the interior of the muffling chamber may hit and be reflected by the wall that faces the discharge port before being discharged to the outside. In this process, the energy of the compressed air can be consumed, thereby reducing the noise generated by the compressed air.

In another exemplary embodiment of the disclosure, the muffling chamber is disposed below the tank.

According to such an embodiment, the condensate is discharged into the muffling chamber. The muffling chamber may be disposed in a relatively small area between the lower surface of the tanks and the surface on which the air compressor is placed. This can effectively reduce the noise as well as discharging the condensate from the tanks in a more rapid and efficient manner. Furthermore, the condensate can be discharged such that it does not fall on the tanks.

In another exemplary embodiment of the disclosure, the air compressor includes a plurality of storage tanks. Furthermore, the discharge pipe may be disposed along a longitudinal direction of the tanks, and the muffling chamber may be disposed along the longitudinal direction of the tanks.

According to such an embodiment, the muffling chamber as well as the wool-like fiber member can be formed along the discharge port of the discharge pipe and in the discharge direction of the compressed air. Due to this configuration, the noise generated by the compressed air can be further reduced. Furthermore, an empty space between the two tanks can be utilized in an effective manner, thereby creating a compact air compressor.

DETAILED DESCRIPTION

The detailed description set forth below, when considered with the appended drawings, is intended to be a description of exemplary embodiments of the present invention and is not intended to be restrictive and/or to represent the only embodiments in which the present invention can be practiced. The term "exemplary" used throughout this description means "serving as an example, instance, or illustration," and should not necessarily be construed as preferred or advantageous over other exemplary embodiments. The detailed description includes specific details for the purpose of providing a thorough understanding of the exemplary embodiments of the invention, it will be apparent to those skilled in the art that the exemplary embodiments of the invention may be practiced without these specific details. In some instances, these specific details refer to well-known structures, components and/or devices that are shown in block diagram form in order to avoid obscuring significant aspects of the exemplary embodiments presented herein.

Figure 1:
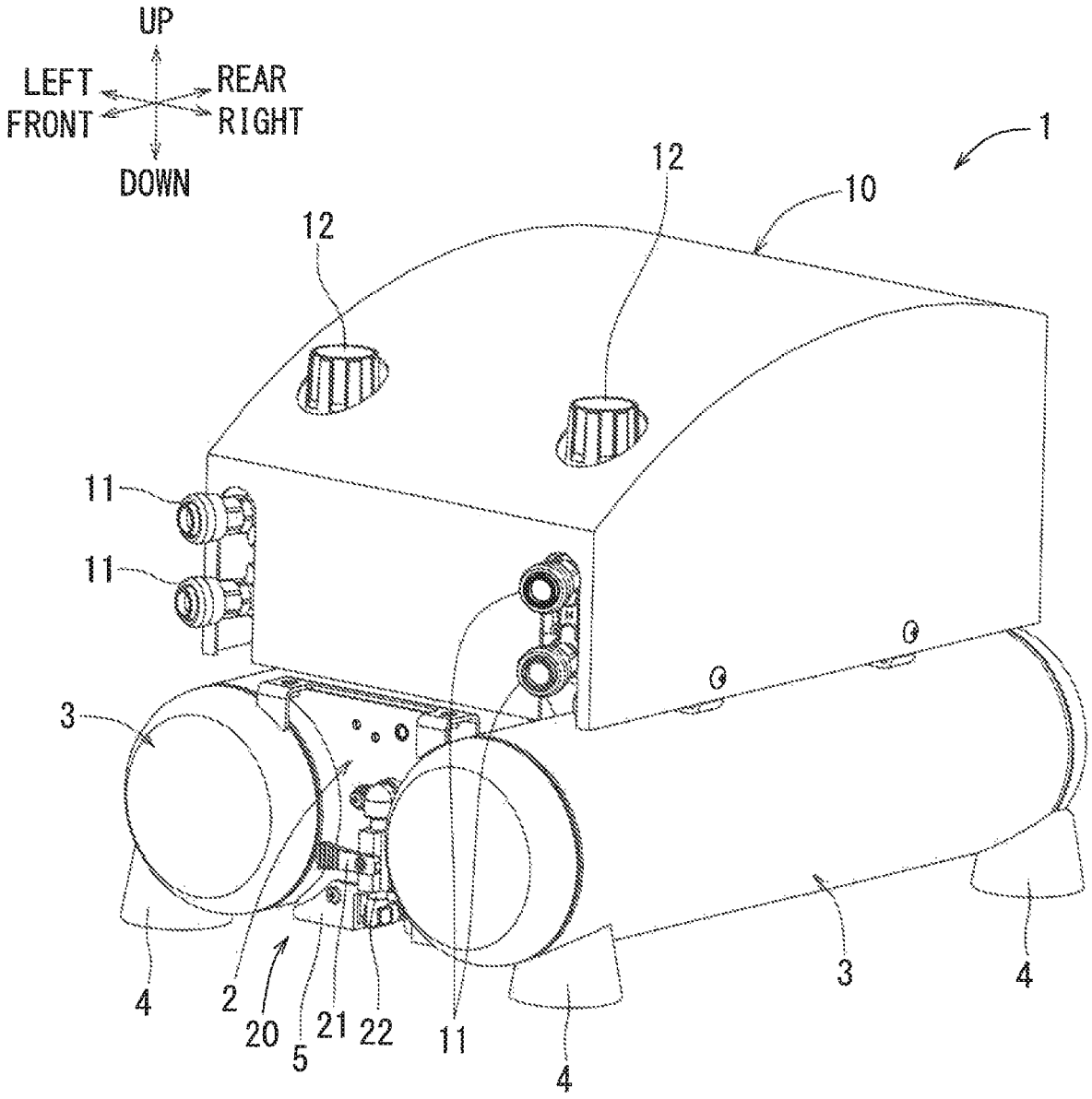
FIG. 1 is an overall perspective view of an air compressor according to an exemplary embodiment (first embodiment) of the present disclosure.

Representative, non-limiting embodiments according to the present disclosure will be described with reference to FIGS. 1 to 7. First, a first embodiment of the present disclosure will be explained with reference to FIGS. 1 to 5. As shown in FIG. 1, an air compressor 1 may include two storage tanks 3. The two tanks 3 may be configured parallel to each other at front and rear locations via a base 2. The base 2 may be disposed between the two tanks 3. A compressing part 10 may be arranged above the two tanks 3. A supporting leg 4 may be disposed on a lower side of each longitudinal end of the tanks 3, and thus the air compressor 1 may have four supporting legs 4. When the air compressor 1 is placed on the ground, for example, the four legs 4 may be made to contact the ground. Due to this configuration, the air compressor 1 can be placed on the ground in a state where the compressing part 10, the base 2, and the two tanks 3 do not contact the ground. In the following embodiments, the front and rear directions of members and configurations may be positioned relative to a side on which a drain cock 21 is disposed in a case where the supporting legs 4 of the air compressor 1 contact the ground. Furthermore, the leftward and rightward directions of the members are described when the air compressor 1 is viewed from the front.

As shown in FIG. 1, an outer periphery of the compressing part 10 may be covered by a housing. The compressing part 10 may include a power mechanism, a cylinder, and a piston (not shown). The power mechanism may comprise, for example, an electric motor that is driven by supplied electric power, or an internal combustion engine that is driven by supplied fuel. The piston may reciprocate inside the cylinder by driving of the power mechanism. Outside air may be introduced to the interior of the cylinder to be compressed according to a reciprocating movement of the piston. The compressed air generated in the cylinder may be delivered to the interior of the tank 3 to be stored.

As shown in FIG. 1, a plurality of joints 11 may be provided at the front of the compressing part 10. The joints 11 may be in fluid communication with the tank 3 such that the compressed air within the tank 3 can be discharged to the outside of the tank 3. An air hose (not shown) may be attached to each of the joints 11. The compressed air may be supplied from the tank 3 via the attached air hose to an air-powered tool such as a nail driver. The nail driver may be driven by the compressed air. Adjusting knobs 12 for adjusting pressure-reducing-valves for the tank 3 may be provided on the upper front of the compressing part 10. The pressure of the compressed air discharged from the joints 11 may be adjusted to an operating pressure of the air-powered tool, for example the nail driver, through rotation of the adjusting knobs 12.

Figure 2:
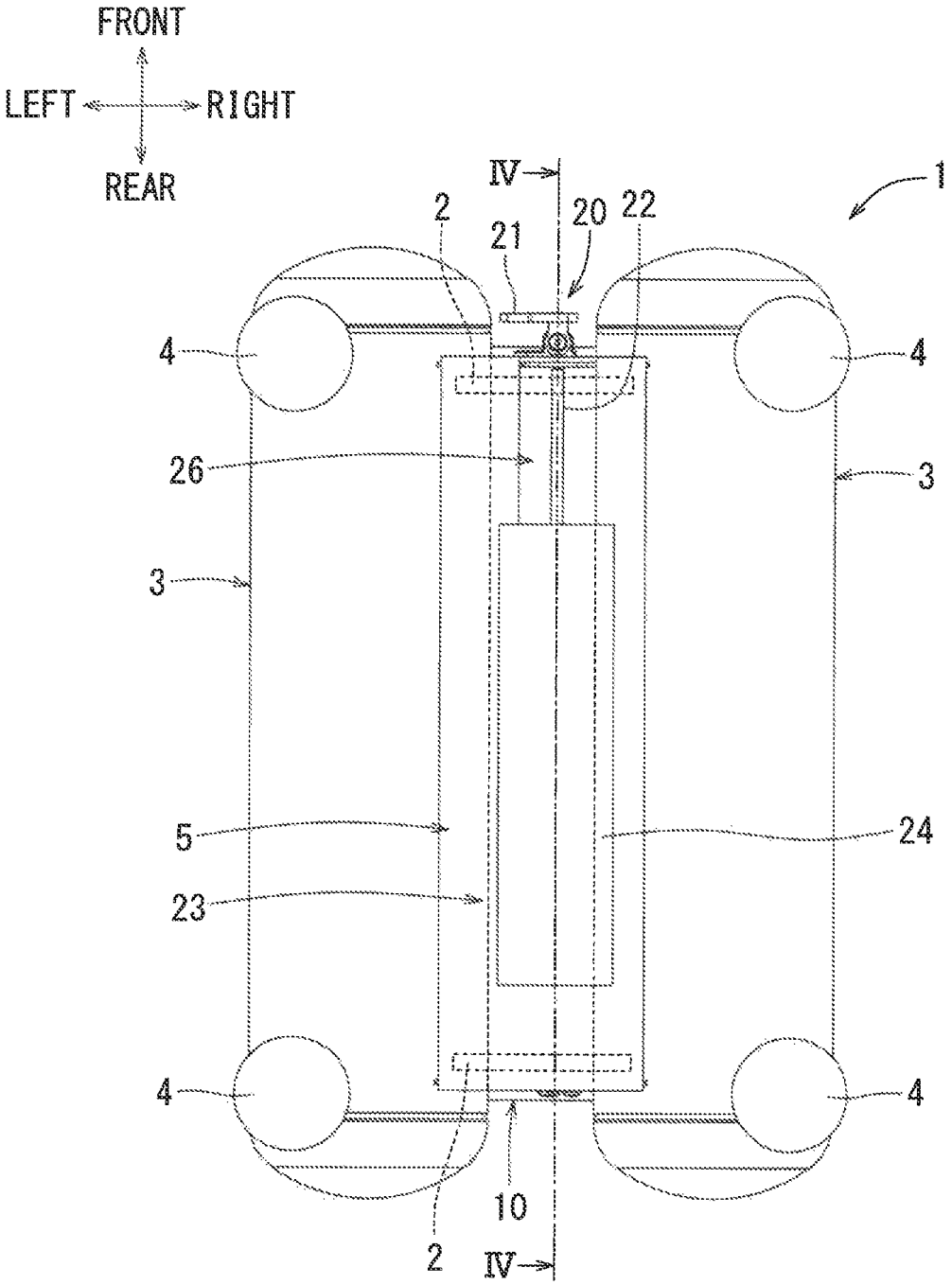
FIG. 2 is a bottom view of the air compressor according to an exemplary embodiment.
Figure 3:
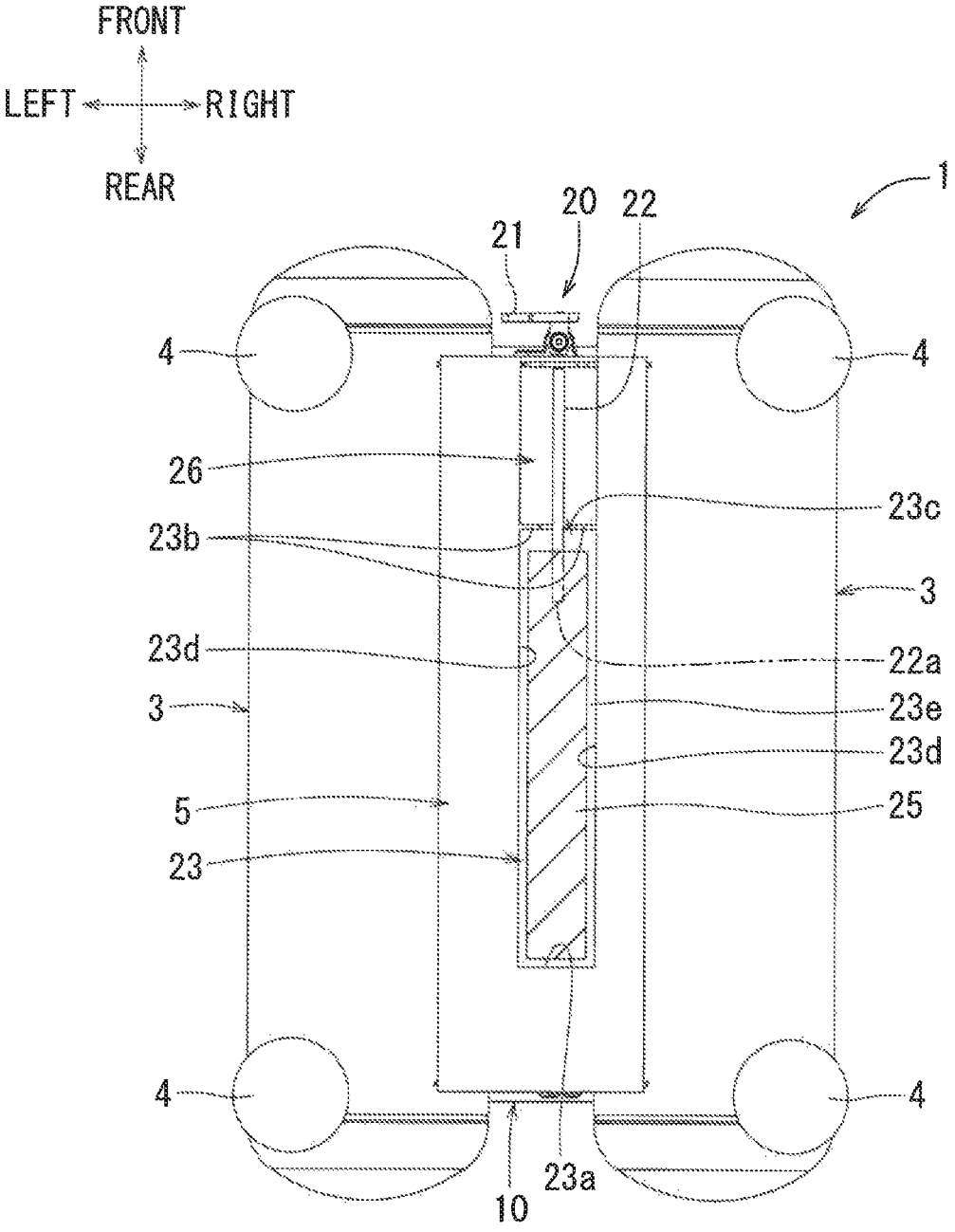
FIG. 3 is a bottom view of the air compressor according to an exemplary embodiment, showing a state in which a lower cover is removed from a muffling chamber.
Figure 4:
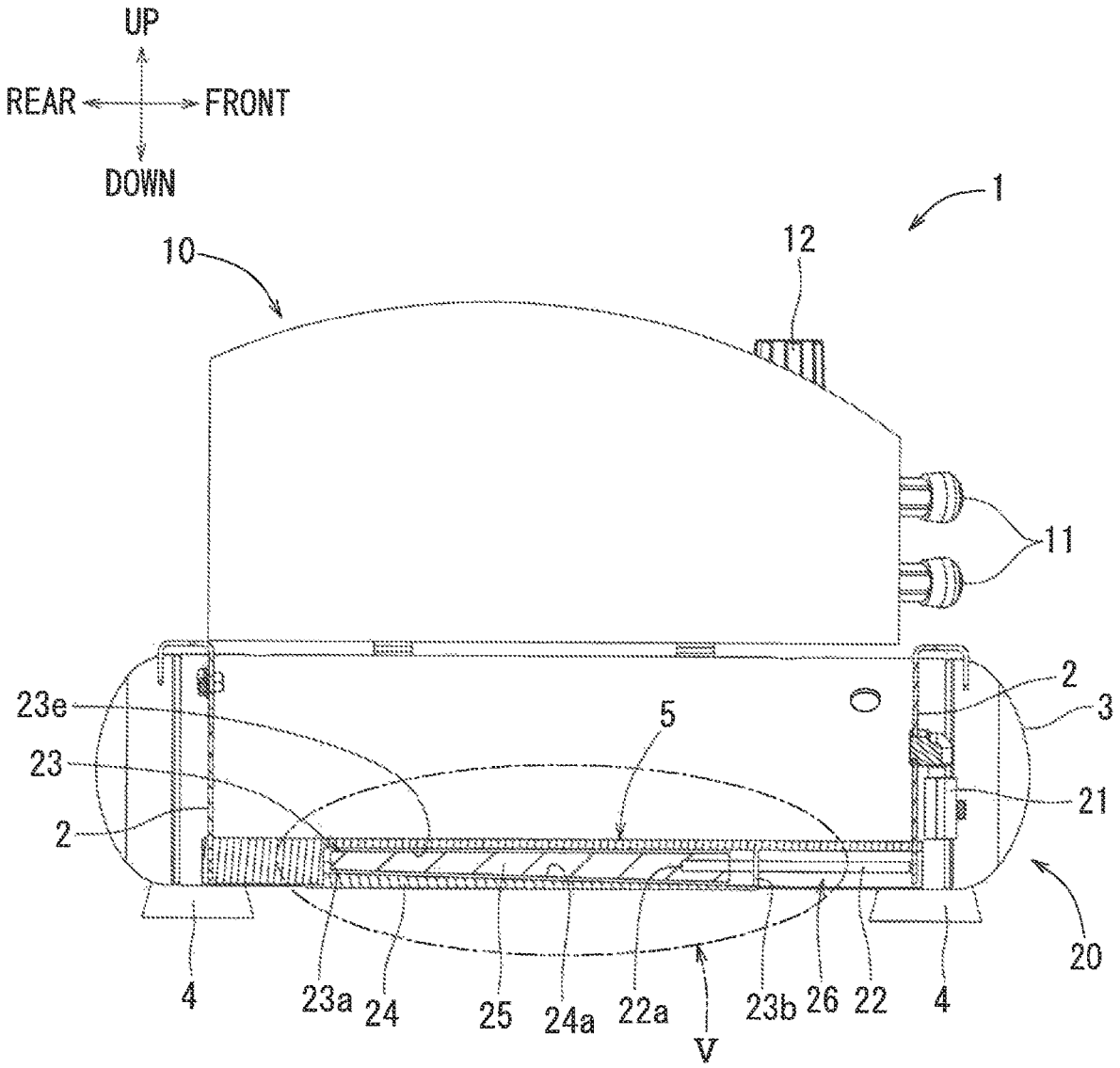
FIG. 4 is a cross-sectional view taken along line IV-IV of FIG. 2, showing a longitudinal cross-sectional view of the air compressor according to an exemplary embodiment.
Figure 5:
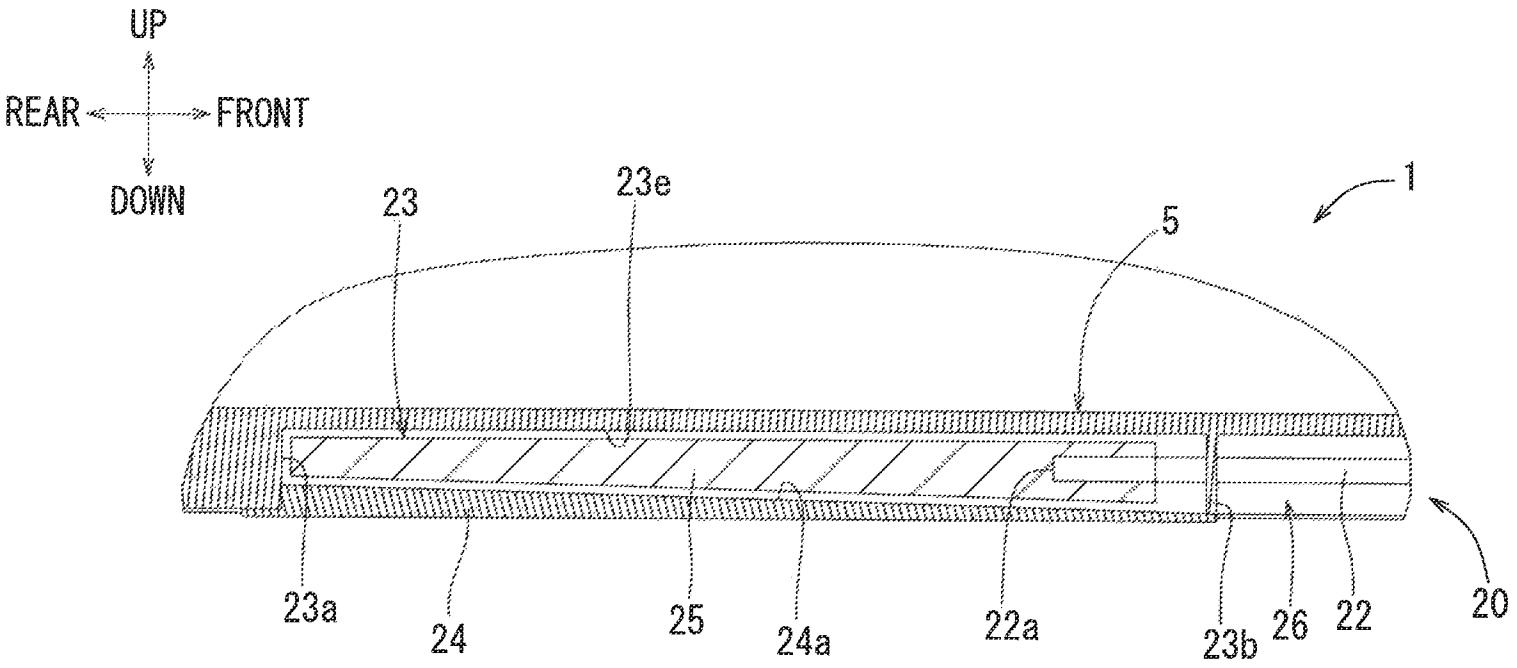
FIG. 5 is a partially enlarged view of a V part of FIG. 4.

As shown in FIGS. 1 to 3, a condensate discharge section 20 may be provided at the front of the base 2. The condensate discharge section 20 may include the drain cock 21 and a discharge pipe 22. The discharge pipe 22 may be turned in the direction of the underside of the tanks 3 and extend in the rearward direction. An auxiliary plate 5 may be attached to the lower side of the two tanks 3. As shown in FIGS. 2 and 3, the auxiliary plate 5 may be disposed along and between the two tanks 3. The front and rear of the auxiliary plate 5 may be screw-fixed to the base 2 (not shown). The auxiliary plate 5 may include a muffling chamber 23 and a muffling-chamber-front-recess 26 as shown in FIGS. 4 and 5. A wool-like fiber member 25 may be housed in the muffling chamber 23. Furthermore, the muffling chamber 23 may be covered by a lower cover 24. The muffling-chamber-front-recess 26 and the muffling chamber 23 may be successively disposed in the longitudinal direction of the tanks 3 (in the front-to-rear direction) between the left and right tanks 3 on the lower surface side of the tanks 3. The muffling chamber 23 may be arranged behind the muffling-chamber-front-recess 26 in the front-to-rear direction. The muffling chamber 23 may extend in the longitudinal direction of the tanks 3 (in the front-to-rear direction), and include a rear wall 23*a*, a left and right walls 23*d*, and an upper wall 23*e*. As shown in FIG. 3, a pair of ribs 23 may be formed between the muffling-chamber-front-recess 26 and the muffling chamber 23. The pair of ribs 23 may extend from the left and right walls 27*d*, respectively, toward the middle of the muffling chamber such that each end thereof faces to each other.

One end of the discharge pipe 22 may be in fluid communication with the tanks 3. The other end of the discharge pipe 22, which is a discharge port 22*a*, may be introduced to the interior of the muffling chamber 23, as shown in FIGS. 1 to 4. The discharge pipe 22 extending from the tanks 3 may further extend from the front end of the base 2 in the downward direction and may be guided to the muffling-chamber-front-recess 26. Furthermore, the discharge pipe 22 may extend from the muffling-chamber-front-recess 25 in the rearward direction. The discharge pipe 22 may then be introduced to the interior of the muffling chamber 23 through between the pair of ribs 23*b*. As shown in FIG. 3, the discharge pipe 22 may pass through the pair of the ribs 23*b* such that a space serving as an outer discharge port 23*c* is generated between the discharge pipe 22 and each of the ribs 23*b*.

As shown in FIGS. 1 to 3, the drain cock 21 may be provided at an intermediate part of the discharge pipe 22 arranged on the front side of the base 2. The drain cock 21 may be configured to be opened and closed by the rotation thereof. When the drain cock 21 is closed, the compressed air and the condensate within the tank may not be discharged from the discharge pipe 22. When the drain cock 21 is opened, the compressed air within the tanks 22 may be discharged from the discharge port 22*a* in accordance with the degree of opening of the drain cock 22. The condensate within the tanks 3 may be discharged from the discharge port 22*a* of the discharge pipe 22 together with the compressed air.

As shown in FIGS. 3 to 5, the wool-like fiber member 25 may be housed in the muffling chamber 23. The wool-like fiber member 25 may comprise "steel wool" (stainless wool) configured of fine fiber members mutually intertwined. Numerous minute gaps (microgaps) may be formed in the wool-like fiber member 25, thereby dispersing the flow of air passing therethrough. Furthermore, the wool-like fiber member 25 may have very high permeability (drainability) and extremely low absorbency (water retentivity), thereby discharging water without holding it. The wool-like fiber member 25 may be housed in such a manner that the muffling chamber 23 is largely packed with the wool-like fiber member 25. The wool-like fiber member 25 may cover at least the surrounding of the discharge port 22*a* of the discharge pipe 22 that is introduced to the interior of the muffling chamber 23.

As shown in FIGS. 4 and 5, the lower cover 24 may be attached to the lower side of the muffling chamber 23. The lower cover 24 may cover the entire lower opening of the muffling chamber 23. As shown in FIGS. 3 to 5, the muffling chamber 23 may become a box-shaped chamber in which only the outer discharge ports 23*c* are opened by attaching the lower cover 24 to the muffling chamber 23. As clearly shown in FIG. 5, a discharge slope 24*a* may be formed on the upper surface of the lower cover 24. The discharge slope 24*a* may be tilted from the rear wall 23*a* toward the ribs 23*b* (from the rear to the front) in the downward direction when the lower cover 24 is attached to the muffling chamber 23.

Referring to FIGS. 3 to 5, the process of how the compressed air and the condensate discharged from the discharge port 22*a* are further discharged to the outside via the muffling chamber 23 will be explained below. The compressed air discharged from the discharge port 22*a* to the interior of the muffling chamber 23 may pass through the minute gaps in the wool-like fiber member 25 and then may hit the rear wall 23*a*. The compressed air may be reflected by the rear wall 23*a* to flow in an opposite direction. The compressed air may again pass through the minute gaps in the wool-like fiber member 25 to be discharged from the outer discharge port 23*c*. The condensate discharged from the discharge port 22*a* to the interior of the muffling chamber 23, together with the compressed air, may flow down to the lower cover 24 passing through the minute gaps in the wool-like fiber member 25. The discharge slope 24*a* of the lower cover 24 may be tilted in the direction toward the outer discharge port 23*c*. In such a configuration, the condensate flown down to the lower cover 24 may flow in the forward direction along the slope 24*a* to be discharged from the outer discharge port 23*c*.

According to the air compressor 1 that is configured as described above, the compressed air discharged from the discharge port 22*a* of the discharge pipe 22 may flow to the interior of the wool-like fiber material 25 that covers the surrounding of the discharge port 22*a*. Afterwards, the compressed air may pass through the wool-like fiber material 25 and be dispersed to the minute gaps formed in the wool-like fiber member 25. Because of this flow, the energy that the compressed air possesses may be consumed while it is passing through the wool-like fiber member 25. This may result in reduced noise as well as prevention of the condensate from being scattered around outside the air compressor 1. The condensate can be discharged to the outside with reduced noise while also being prevented from being scattered around outside the air compressor 1. As a result, the drain cock 21 can be fully opened to rapidly complete discharging the condensate to the outside. Furthermore, due to the high permeability (drainability) and extreme low water absorbency (water holding property) of the wool-like fiber member 25, the condensate discharged from the discharge port 22*a* may flow to the outside. Preferably, the condensate does not remain in the minute gaps formed in the wool-like fiber member 25. In this way, the compressed air and the condensate can be discharged to the outside in an efficiently manner while the permeability of the wool-like fiber member 25 is retained.

Furthermore, in the air compressor 1 discussed above, the wool-like fiber member 25 may be made of stainless steel having a high strength. Due to this configuration, the wool-like fiber member 25 can be protected from damage caused by the compressed air that is vigorously discharged from the discharge port 22*a*. Furthermore, the wool-like fiber member 25 may be made of metal wool (steel wool) that is heavier than, for example, resin. As compared to a member made of resin, the wool-like fiber member 25, here, may be more restricted from being moved from its initial position. Such movement is typically caused by the compressed air that is vigorously discharged from the discharge port 22*a*. Thus, the wool-like fiber member 25 may be held in such a manner as to cover the surrounding of the discharge port 22*a*. Furthermore, coverage of the surrounding of the discharge port 22*a* by the wool-like fiber material 25 can reduce noise generated by the compressed air. In addition to this, rust prevention measures can be taken by the use of the wool-like fiber member 25 that is made of stainless steel. "Steel wool", for example a metallic scrubbing brush, can be used as the wool-like fiber material 25. Because of this, the wool-like fiber member 25 may not require specific requirements such as size or shape, thereby reducing manufacturing cost of the air compressor 1.

Furthermore, according to the air compressor 1 discussed above, the compressed air introduced to the interior of the muffling chamber 23 may hit and be reflected from the rear wall 23*a*, and then discharged to the outside through the outer discharge port 23*c*. Because of this flow path, the distance where the compressed air passes through the minute gaps in the wool-like fiber material 25 may become large and consume energy that the compressed air possesses. Due to this air flow, noise generated by the compressed air can further be reduced. Furthermore, the muffling chamber 23 may be largely packed with the wool-like fiber material 25, thereby restricting the wool-like fiber material 25 from being moved from its initial position where it covers the surrounding of the discharge port 22*a*.

Furthermore, according to the air compressor 1 discussed above, the discharge pipe 22 extending from the tanks 2 may be introduced to the interior of the muffling chamber 23 that is disposed below the tanks 2. In this configuration, the condensate can easily flow to the discharge pipe 22 (due to gravity). Furthermore, the condensate may be discharged in the muffling chamber 23 that is disposed in a relatively small area between the lower surface of the tanks 3 and the surface on which the air compressor 1 is placed. As discussed above, the condensate can be discharged from the tanks 3 in a rapid and efficient manner while generation of noise can be reduced. Furthermore, the outer discharge port 23*c* is opened in the downward direction, thereby discharging the condensate such that it does not fall on the tanks 3 etc.

Furthermore, according to the air compressor 1 discussed above, the discharge pipe 22 may be disposed between the two tanks 3 along the longitudinal direction of the tanks 3 (in the front-to-rear direction), and the wool-like fiber material 25 may be disposed around the discharge port 22*a* and in the discharge direction of the compressed air. The muffling chamber 23 and the wool-like fiber member 25 may be formed long in the front-to-rear direction. Because of this configuration, the distance where the compressed air passes through the minute gaps in the wool-like fiber material 25 may become large, thereby reducing the noise generated by the compressed air. Furthermore, an empty space between the two tanks 3 can be utilized in an effective manner, thereby making the air compressor 1 compact.

Next, a second embodiment of the present disclosure will be explained with reference to FIGS. 6 and 7. In the air compressor 30 according to the second embodiment, a lower cover 44 may have a different size from the lower cover 24 of the air compressor 1 according to the first embodiment. In more detail, the lower cover 44 of the second embodiment may be configured to be shorter than the lower cover 24 of the first embodiment in the longitudinal direction. Because of this difference in length, a front portion of the muffling chamber 23 may not be covered by the lower cover 44 of the second embodiment. The muffling chamber 23 may be completely covered by the lower cover 24 of the first embodiment. Similar to the condensate discharge section 20 of the first embodiment, a condensate discharge section 40 of the second embodiment may be disposed between the two tanks 3. Furthermore, the condensate discharge section 40 may include a drain cock 41, a discharge pipe 42, and an auxiliary plate 6. The auxiliary plate 6 may include a muffling chamber 43 and a muffling-chamber-front-recess 46. A wool-like fiber member 45 may be housed in the muffling chamber 43. As discussed above, the lower cover 44 may cover a part of the lower side of the muffling chamber 43.

Figure 6:
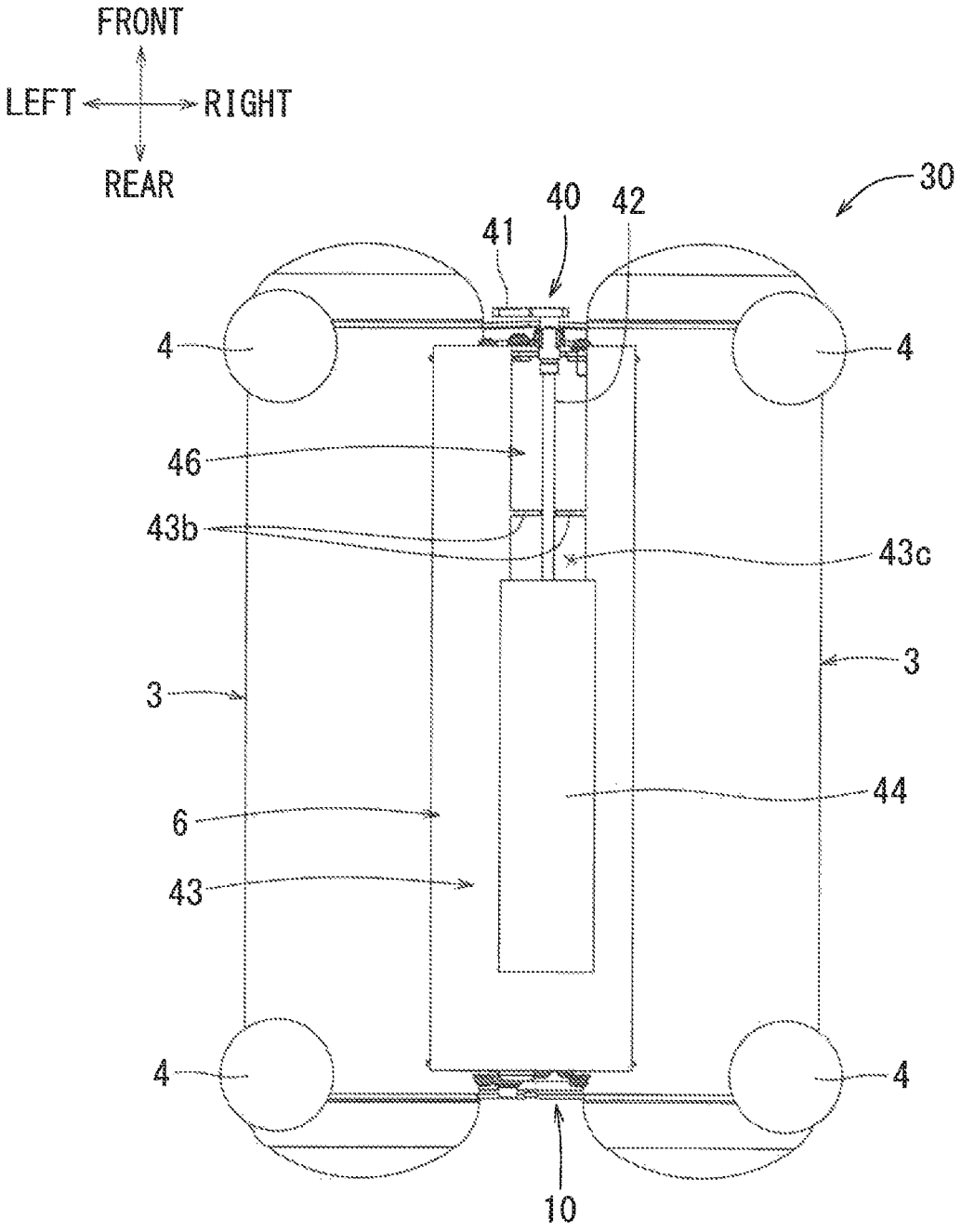
FIG. 6 is a bottom view of an air compressor according to another exemplary embodiment (second embodiment) of the present disclosure.
Figure 7:
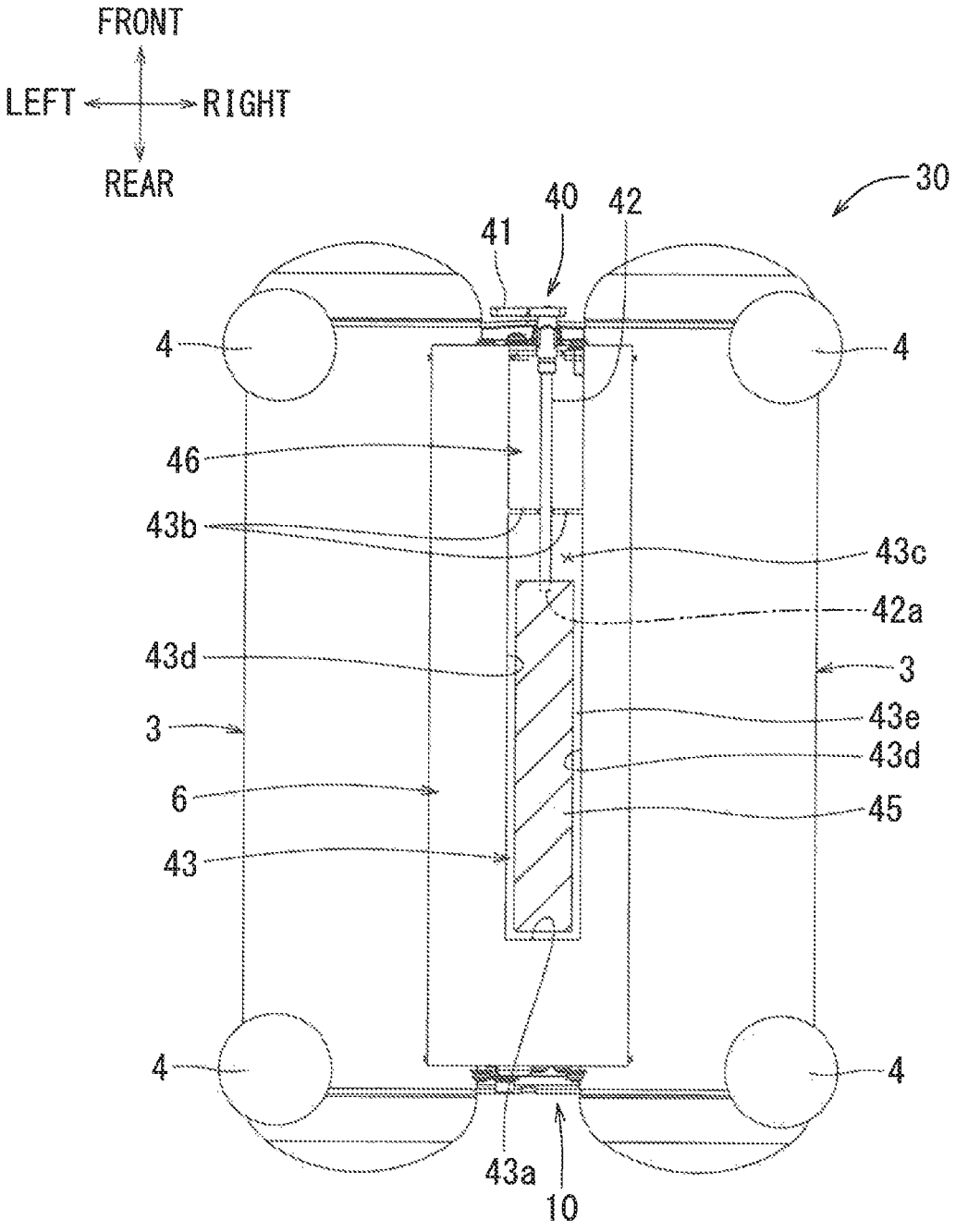
FIG. 7 is a bottom view of the air compressor according to an exemplary embodiment, showing a state in which a lower cover is removed from a muffling chamber.

As shown in FIGS. 6 and 7 and similar to the air compressor 1 of the first embodiment, the muffling-chamber-front-recess 46 and the muffling chamber 43 may be disposed below the tanks 3 between the left and right tanks 3 in the longitudinal direction of the tanks 3 (in the front-to-rear direction). The muffling chamber 43 may be disposed behind the muffling-chamber-front-recess 46. The muffling chamber 43 may extend in the longitudinal direction of the tanks 3 (in the front-to-rear direction). The muffling chamber 43 may have a rear wall 43*a*, a left and right walls 43*d*, and an upper wall 43*e*. A pair of ribs 43*b* may be formed between the muffling-chamber-front-recess 46 and the muffling chamber 43. The pair of ribs 43*b* may extend from the left and right walls, respectively, toward the middle of the muffling chamber 43 such that each end thereof faces each other.

As shown in FIGS. 6 and 7 and similar to the discharge pipe 22 of the first embodiment, one end of the discharge pipe 42 may be in fluid communication with the tanks 3. The other end thereof may be introduced to the interior of the muffling chamber 43. In a similar manner to the discharge pipe 22, the discharge pipe 42 may be arranged at the front of the air compressor 30 with regard to the base 2 and the muffling-chamber-front-recess 46. A drain cock 41 may be provided at the intermediate part of the discharge pipe 42 that is disposed on the front side of the base 2. Similar to the drain cock 21 of the first embodiment, the drain cock 41 may be configured to be opened and closed by the rotation thereof. The discharge pipe 42 that is introduced to the interior of the muffling chamber 43 from the muffling-chamber-front-recess 46 may firm a path between the pair of the ribs 43*b*. In the second embodiment, the pair of ribs 43*b* may be formed in such a manner that little clearance is present between the discharge pipe 42 and each end of the ribs 42.

As shown in FIG. 7, the wool-like fiber member 45 may be housed in the muffling chamber 43. Similar to the wool-like fiber member 25 of the first embodiment, the wool-like fiber member 45 may comprise "steel wool" (stainless wool). The wool-like fiber member 45 may be disposed to cover the surrounding of the discharge port 42*a* of the discharge tube 42 that is introduced to the interior of the muffling chamber 43. Furthermore, the wool-like fiber member 45 may be housed in the muffling chamber 43 in such a manner that the rear region of the muffling chamber 43 behind the discharge port 42*a* is filled with the wool-like fiber member 45.

As shown in FIGS. 6 and 7, the lower cover 44 may be attached to the lower side of the muffling chamber 43. The lower cover 44 may partially or fully cover an opening on the lower side of the muffling chamber 43. In certain implementations, a front end area in the vicinity of the ribs 43*b* is not covered by the lower cover 44. When the lower cover 44 is attached to the muffling chamber 43, the front end portion of the lower cover 44 may be disposed at least in front of the discharge port 42*a* in the front-to-rear direction. An opening present in the lower front end portion of the muffling chamber 43, which is not covered by the lower cover 44, may serve as an outer discharge port 43*c*. By attaching the lower cover 44 to the muffling chamber 43, the muffing chamber 43 may provide a box-like space in which only the outer discharge port 43*c* is open. Similar to the lower cover 24 of the first embodiment, a discharge slope (not shown) that is tilted downward from the rear to the front may be formed on the upper surface of the lower cover 44.

Referring to FIGS. 6 and 7, a process of how the compressed air and the condensate discharged from the discharge port 42*a* are further discharged to the outside via the muffling chamber 43 will be explained below. The compressed air discharged from the discharge port 42*a* to the interior of the muffling chamber 43 may pass through the minute gaps in the wool-like fiber member 45 and then may hit the rear wall 43*a*. The compressed air may be reflected by the rear wall 23*a* to flow in the opposite direction. The compressed air may again pass through the minute gaps in the wool-like fiber member 45 to be discharged from the outer discharge port 43*c*. The condensate discharged from the discharge port 42*a* to the interior of the muffling chamber 43, together with the compressed air, may flow down to the lower cover 44 while passing through the minute gaps in the wool-like fiber member 25. The discharge slope of the lower cover 44 may be tilted in the direction toward the outer discharge port 43*c*. In such a configuration, the condensate flown down to the lower cover 44 may flow in the forward direction along the slope and be discharged from the outer discharge port 43*c*.

According to the second embodiment discussed above, the air compressor 30 may comprise the outer discharge port 43*c* having an opening area larger than that of the outer discharge port 23*c*. In this configuration, the air compressor 30 can discharge the condensate from the muffling chamber 43 in a more efficient manner. In the air compressor 30, the compressed air discharged from the discharge port 42*a* may be dispersed within the wool-like fiber member 45 having numerous minute gaps. The wool-like fiber member 45 may consume the energy of the compressed air. In such a configuration, the noise generated in the air compressor 30 can be reduced in the condensate discharge section 40 in a similar way to the condensate discharge section 20 in the air compressor 1. According to the second embodiment, the condensate can be discharged in a vigorous manner to rapidly complete the discharging task with reduced noise.

The first and second embodiments discussed above may be further modified without departing from the scope and spirit of the present teachings. For example, the wool-like fiber member may not be limited to stainless wool. Alternatively, it may be another metal material that is hard to rust. Furthermore, it may not be limited to metal material. Alternatively, "glass wool" comprising, for example, glass fibers, may be used. Furthermore, it may not be limited to fiber material. Alternatively, for example, a material which is formed by sintering numerous minute metal balls to produce numerous gaps may be used for housing in the muffling chamber. Furthermore, shapes and allocations for the muffling chamber and the outer discharge port may be modified as needed. For example, a penetrating hole may be formed in the front portion of the lower case that covers an entirety of the lower opening of the muffling chamber in order to serve as an outer discharge port.

What is claimed is:

1. An air compressor, comprising:

a compressor that is configured to compress outside air to produce compressed air;

a storage tank that is configured to store the compressed air;

a condensate discharge section that is configured to selectively discharge condensate and the compressed air from the storage tank to outside the air compressor; and a fiber member with high permeability; wherein:

the condensate discharge section includes (1) a discharge pipe configured such that the condensate and the compressed air flow from the storage tank through the discharge pipe and (2) a drain cock that is configured to open and close the discharge pipe;

the discharge pipe extends in a front-rear longitudinal direction straight from the drain cock to a discharge port of the discharge pipe;

the fiber member is at least around the discharge port of the discharge pipe; and the condensate discharge section, the fiber member and a chamber housing the fiber member are configured to directly discharge the condensate from the air compressor through an outer discharge port between the discharge pipe and each of a pair of ribs.

2. The air compressor according to claim 1, wherein the fiber member is made of metal.

3. The air compressor according to claim 1, wherein the fiber member surrounds the discharge port.

4. The air compressor according to claim 1 wherein:

the chamber is a muffling chamber that receives the discharge pipe;

the muffling chamber surrounds the discharge port; and the fiber member is at least partially in an interior of the muffling chamber.

5. The air compressor according to claim 4, wherein the muffling chamber includes a wall that faces the discharge port.

6. The air compressor according to claim 4, wherein the muffling chamber is below the storage tank when the air compressor is properly positioned on and supported by a surface.

7. The air compressor according to claim 4, further comprising:

a second storage tank, wherein:

the discharge pipe is disposed between the storage tank and the second storage tank and extends along a longitudinal direction of the storage tank and the second storage tank; and the muffling chamber extends along the longitudinal direction of the storage tank and the second storage tank.

8. The air compressor according to claim 1, wherein the condensate discharge section and fiber member are configured to discharge the condensate from the air compressor before the fiber member is fully saturated with the condensate.

9. The air compressor according to claim 1, wherein:

the chamber is a muffling chamber that receives the discharge pipe;

the muffling chamber extends along a longitudinal direction in which the storage tank primarily extends; and the muffling chamber extends beyond a midpoint of the storage tank in the longitudinal direction.

10. An air compressor, comprising:

a compressor that is configured to compress outside air to produce compressed air;

a storage tank that is configured to store the compressed and extends in a front-rear longitudinal direction;

a condensate discharge section that is configured to selectively discharge the compressed air stored in the storage tank and condensate that is generated in the storage tank to outside the air compressor; and a fiber member with high permeability, wherein:

the condensate discharge section includes:

a discharge pipe that (1) is in a fluid communication with the storage tank and (2) is configured such that the condensate and the compressed air are discharged from the storage tank through the discharge pipe;

a drain cock that is configured to open and close the discharge pipe;

a muffling chamber that (1) receives the discharge pipe, (2) includes, with reference to the longitudinal direction and when the air compressor is properly positioned on and supported by a surface, an upper wall, a rear wall, lateral walls facing each other, and an opening that faces downwards and a pair of opposing ribs, each of the pair of opposing ribs extending inwardly from one of the lateral walls; and a lower cover that is attached to a downward side of the muffling chamber to cover the opening of the muffling chamber and that is tilted from the rear wall toward a front of the lower cover in the downward direction, the discharge pipe passes between the pair of ribs;

the fiber member is housed in the muffling chamber such that the fiber member surrounds a discharge port of the discharge pipe; and the muffling chamber and the lower cover are configured to discharge the condensate from the air compressor through an outer discharge port between the discharge pipe and each of the pair of ribs.

11. The air compressor according to claim 10, wherein:

a space is present between the discharge pipe and each end of the pair of ribs; and the lower cover covers an entirety of the opening of the muffling chamber.

12. The air compressor according to claim 10, wherein:

little clearance is present between the discharge pipe and each end of the pair of ribs; and the lower cover partially covers the opening of the muffling chamber such that a front end area in the vicinity of the ribs is not covered by the lower cover.

13. The air compressor according to claim 10, wherein the fiber member is made of metal.

14. The air compressor according to claim 10, wherein the muffling chamber is below the storage tank.

15. The air compressor according to claim 10, further comprising a second storage tank extending in the front-rear longitudinal direction, wherein;

the discharge pipe is between the storage tank and the second storage tank and extends in the front-rear longitudinal direction; and the muffling chamber extends along the front-rear longitudinal direction.

16. The air compressor according to claim 10, wherein the compressor includes an adjusting knob configured to adjust a pressure-reducing valve for the storage tank and a joint from which the compressed air is supplied to an air-powered tool via a hose attached thereto.

17. The air compressor according to claim 10, wherein:

the front-rear longitudinal direction is a direction in which the storage tank primarily extends; and the muffling chamber extends beyond a midpoint of the storage tank in the longitudinal direction.

* * * * *